United States Patent [19]

Leslie et al.

[11] 4,161,910

[45] Jul. 24, 1979

[54] STRAP FEEDING AND TENSIONING ASSEMBLY

[75] Inventors: John H. Leslie, Winnetka; George A. Crosby, Long Grove, both of Ill.

[73] Assignee: Signode Corporation, Glenview, Ill.

[21] Appl. No.: 907,689

[22] Filed: May 19, 1978

[51] Int. Cl.[2] ..... B65B 13/06

[52] U.S. Cl. ..... 100/26; 100/32

[58] Field of Search ..... 100/8, 26, 29, 30, 32

[56] References Cited

U.S. PATENT DOCUMENTS

| | | | |
|---|---|---|---|
| 3,023,693 | 3/1962 | Crosby | 100/32 |
| 3,232,217 | 2/1966 | Harmon | 100/30 |
| 3,493,014 | 2/1970 | Orban | 100/30 |
| 3,526,187 | 9/1970 | Gilliard | 100/30 X |
| 3,566,778 | 3/1971 | Vilcins | 100/32 X |
| 3,752,058 | 8/1973 | Lems | 100/32 |

*Primary Examiner*—Billy J. Wilhite

*Attorney, Agent, or Firm*—Dressler, Goldsmith, Clement, Gordon & Shore, Ltd.

[57] ABSTRACT

An apparatus is provided on a strapping machine frame adjacent a strap chute and adjacent a strap end gripping and sealing assembly and has a pivotably mounted strap guide arm and gripper for guiding the strap during feeding in a first, upper position and for gripping the strap when the arm moves downwardly away from the first position. A single, reversible, rotating drive motor is mounted for movement with the guide arm and powers a gear drive assembly which is engaged with the motor and movable therewith for (1) rotating feedwheels to feed the strap to form a loop when the motor is rotating in a first direction, (2) rotating the feedwheels to withdraw the strap to pretension the loop with a first predetermined tension when the motor is rotating in a second direction, and (3) rotating a high tension pinion gear when both (a) the motor is rotating in the second direction and (b) the tension in the strap exceeds the predetermined, first tension. During high tensioning, the pinion gear moves along a rack and pivots the guide arm out of the first position to a second position whereby a gripper is actuated to grip the trailing portion of the strap and pull the gripped strap, thereby drawing a higher, second tension in the loop.

13 Claims, 9 Drawing Figures

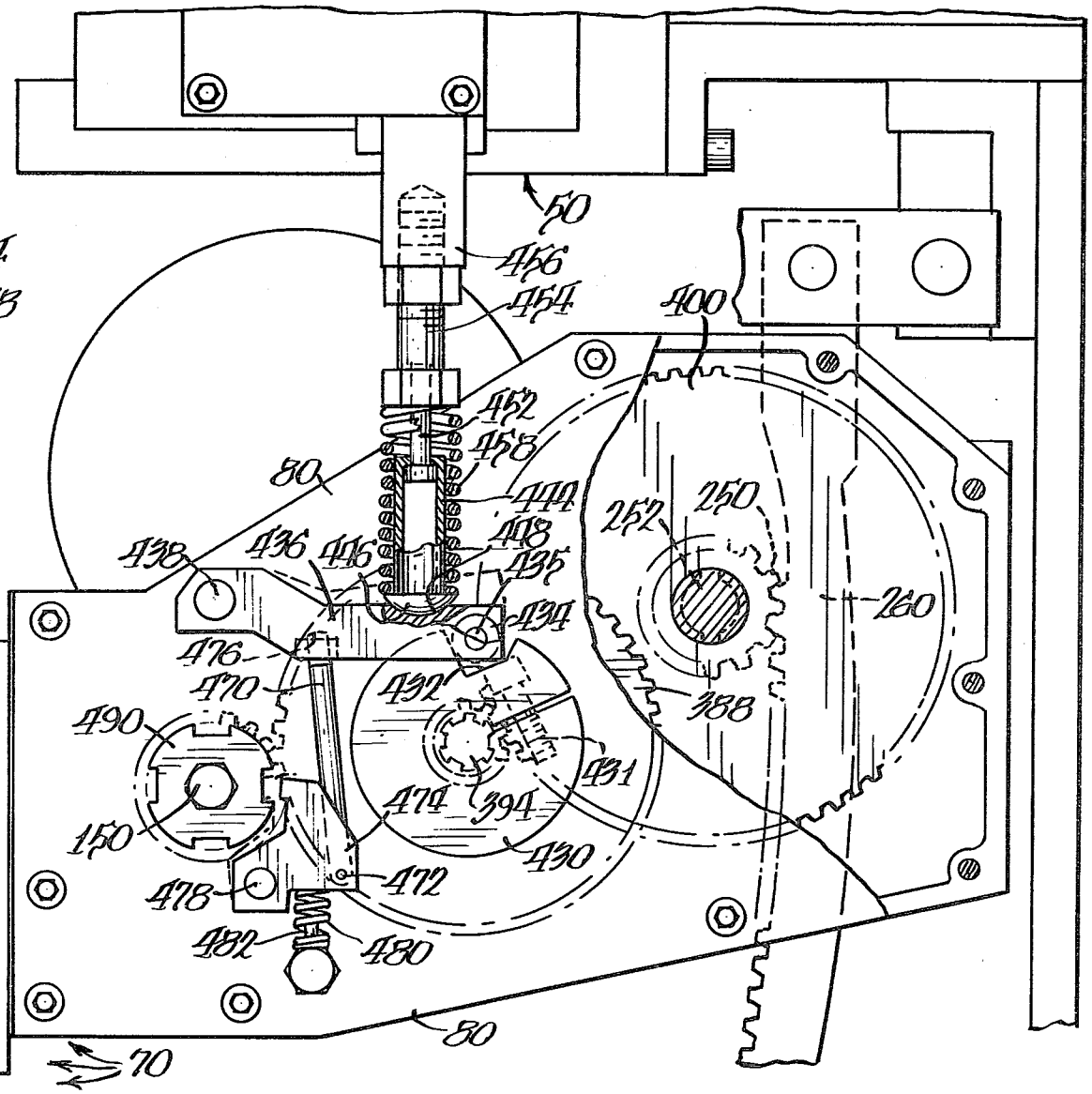
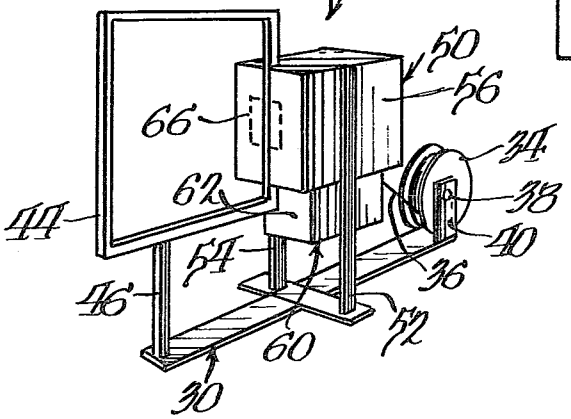
FIG. 1.
FIG. 7.

5
5
8
8
40
60
70
76
78
80
92
96
116
132
140
142
160
162
164
166
178
180
182
184
186
188
194
196
198
199
200
210
212
214
216
220
240
250
260
264
266
270
272
288
294
298
300
494
496
500
226

72
78
76
6
50
70
90
122
132
128
146
142
166
148
130
150
168
163
110
146
196
198
120
124
199
196
194
198
80
240
242
252
250
176
90
260
314
318
312
236
96
60
194
228
226
230
294
240
6
226

60
50
72
76
78
70
36
128
140
168
150
163
146
80
496
498
90
130
142
148
100
166
144
110
130
194
196
198
199
206
250
252
240
244
90
96
494
242
499
234
236
260
264
266
270
272
296
294
280
284
276
274
286
282
288
290
298
300
230
228
226
36
226

STRAP FEEDING AND TENSIONING ASSEMBLY

BACKGROUND OF THE INVENTION

Signode Corporation, the assignee of the entire interest of the present invention, has heretofore developed several machines for feeding strap in a chute to form a loop around an article to be strapped and for tensioning the loop tight about the article. Typically, these machines also apply a seal to the tensioned loop or otherwise form a connection between the overlapping strap segments in the loop, and then sever the tensioned and sealed loop from the trailing length of strap.

The apparatus of the present invention relates to such strapping machines and is adapted to form a part of a strapping machine. Specifically, the apparatus of the present invention is intended to be used in a machine having a strap chute and a strap end gripping and sealing unit. The apparatus of the present invention feeds the strap into the chute and in a loop about a package. Subsequently, it first draws the loop tight about the package and then applies a high tension, during the application of which, the strap end gripping and sealing mechanism connects the overlapped ends of the strap loop.

Typically, after strap is fed into a strap chute around the package or article to be tied, and after the leading end of the strap is gripped by an appropriate strap end gripping mechanism, the strap loop is drawn tight around the article or package to a certain predetermined tension. This is referred to as "pre-tension". It is desirable, from the standpoint of strapping packages as quickly as possible, to perform the strap feeding and pre-tensioning operations as rapidly as possible. Thus, it would be desirable to provide a means for rapidly feeding and withdrawing the strap from the strap chute to tighten the loop about the package.

Though it is generally desired to perform all strapping operations as rapidly as possible, including the above-discussed feeding and "pre-tensioning" steps, the step of applying the final, high tension to the strap loop (before the overlapping strap ends are connected), is best performed relatively slowly. With many types of articles or packages which are bound by a loop of tensioned strap, the article or package may compress relatively slowly in response to a suddenly applied strap loop tension. The compression that continues to occur for some time after the sudden application of high tension will cause a subsequent reduction in the effective strap loop tension. Further, with many types of packages, the package and/or strapping machine tend to move relative to each other as the high tension is being applied. Thus, if the high tension is applied suddenly, proper securement of the package may not be achieved because of the possibility of post-tension compression of the package and because of the possibility that any necessary relative movement between the package and the strapping machine is not properly accommodated.

Additionally, the application of high tension at a high rate requires a great amount of power. High power requirements greatly increase the cost, size, and weight of strapping machines with few or no compensating benefits.

In order to feed the strap relatively rapidly into the strap chute and in order to rapidly draw the strap loop tight about the package during the "pre-tension" sequence, yet execute the high tension sequence relatively slowly, strapping machines in the past have been designed a number of different ways. Some machines have used a separate means (such as a hydraulic motor) to feed and/or pretension the loop and have used another separate means (such as an electric or hydraulic motor or pneumatic cylinder operator) to draw the high tension. Other machines have used transmissions that shift into a low gear for applying high tension, but these require an external control system or signal (e.g., traction wheel air motor back up pressure or strap switch release from a holding gate). It would be desirable to provide a strapping apparatus in which a single motor or drive means could be used to effect the feeding, pretensioning, and high tension sequences without the need for external controls or signals to shift from a high speed, low torque mode to a low speed, high torque mode.

Some strapping machines have been developed wherein a single motor is used to retract the trailing strap and pretension the strap about an article at high speed and to subsequently apply the high tension at the same high speed. However, high speed application of the final, high tension, as performed by these machines, is not always desirable for the reasons discussed above. Thus, it would be desirable to provide a strapping apparatus wherein a single drive means or motor could be used to apply the pretension relatively rapidly and to apply the high tension relatively slowly.

It would further be desirable to provide an electric motor to apply both the rapid pretension and the slow high tension instead of non-electric motor means (such as hydraulic or pneumatic actuators) to avoid having to supply hydraulic fluid under pressure or compressed air to the apparatus.

It would also be beneficial to provide a single, relatively low power electric motor for applying a rapid pretension and a slow high tension, without the requirement for a more costly, large, variable speed motor.

It would be advantageous to provide a single electric motor for applying the high tension to a strap loop, which motor would be small enough, when coupled with any necessary gear transmission mechanisms, to permit relatively efficient operation off of ordinary electrical lighting circuits as opposed to 3 phase, 220 volt or greater AC circuits.

Another salient feature would include means for feeding the strap by rotating members or traction wheels in direct contact with the strap, which wheels would not bite into, or otherwise damage, the strap. Prevention of scratches or other damage to the strap is very important since damaged strap can fail under tension and/or take on a "camber" which causes binding in the strap guide. Further, with metal strap, surface damage can provide a starting point for rust.

Further, it would be helpful if such traction wheels would slip when a predetermined, high torque was being transmitted to the wheels to prevent damage to the apparatus.

It would also be of some utility to provide traction wheels for feeding the strap, which wheels would have good wear characteristics and which, if biased together during periods of machine shut-down, would not deform and develop permanently set flat spots.

In connection with using a single electric motor, it would be very desirable to provide a power transfer or gear drive assembly means with two speed dual output capability for automatically transferring the motor power from the traction wheels at high speed during pretensioning to a suitable high tensioning assembly for applying the final high tension at low speed, without the need for complicated controls, by the automatic direct sensing of strap tension.

A further salutary effect would be realized by providing a strap feeding and tensioning apparatus that was relatively self-contained and relative lightweight and small so as to readily adaptable to many different packaging requirements and so that it could be easily and quickly replaced on site.

SUMMARY OF THE INVENTION

The strap feeding and tensioning assembly of the present invention comprises a relatively compact unit in the form of a pivotable strap guide arm with which is associated a single, reversible electric motor, a traction wheel means or pair of traction wheels, a gripper means for gripping a portion of the strap in the strap guide arm, a high tension drive member or pinion gear, a gear drive assembly connecting the motor with both the traction wheels and the high tension pinion gear, and a high tension reaction means or rack engaged with the pinion gear.

The above-described basic components of the assembly are mounted in or on a suitable frame or housing and except for the rack, are all fixed relative to one another for movement with the guide arm. The guide arm has a pivot axle on one end for pivotably mounting the guide arm on a strapping machine frame adjacent a strap chute and adjacent a strap end gripping and sealing assembly. Preferably, the guide arm is mounted below a strap end gripping and sealing assembly with one end of the guide arm adjacent the strap chute and with the pivotably mounted end of the guide arm spaced away from the strap chute. The strap guide arm is movable about its pivot point between a first, upper position for strap feeding and pretensioning and a second, lower position for applying the final high tension.

The high tension pinion gear is located in engagement with the rack between the guide arm pivotable mount and the end of the guide arm adjacent the strap chute. In the preferred embodiment, the rack is pivotably secured at one end to the strapping machine frame. The pinion gear is adapted to be rotated about an axis fixed in the guide arm, and as it is so rotated in engagement with the rack, move in one direction or the other, depending upon the direction of rotation, along the rack. As the pinion gear moves along the rack, the entire strap guide arm swings about the pivot point. This action is used to apply the high tension to the strap loop after the strap loop has been pretensioned about the package.

The strap guide arm has a channel for receiving strap passing through the guide arm and into the strap chute. The two traction wheels are mounted on the guide arm on either side of the strap guide and are arranged to contact the side surfaces of the strap. Opposed rotation of the traction wheels, in the appropriate directions, causes the strap to be fed either forwardly into the strap chute to form a loop, or rearwardly out of the strap chute when drawing the loop tight about the package during the pretension sequence.

On the guide arm, between the traction wheels and the strap chute, a pivotable gripper is located adjacent the strap and is operated through appropriate linkages, to grip the strap at the appropriate time during the high tension step.

A novel gear drive assembly, mounted on the strap guide arm and movable therewith, drivably connects the electric motor with the traction wheels and with the high tension pinion gear. The gear drive assembly has basically two output drives connected through a differential gear subassembly. One drive is directly connected to the traction wheels and the other drive is connected, through a gear reduction train, to the high tension pinion gear. Through these drives, the electric motor feeds the strap into a loop at high speed, rapidly pretensions the strap, and finally pulls high tension on the strap.

When the final high tension is applied, the overlapping strap ends in the strap loop are sealed or otherwise joined together and the trailing portion of the strap is severed.

With this novel strap feeding and tensioning assembly, it is thus seen that a single, small electric motor, such as can be operated from conventional electric lighting circuits, can both feed and pretension the strap at a high rate of speed and can subsequently apply high tension to the strap, through the gear reduction train, at a very low speed without the need for complicated controls. This is advantageous from the standpoint of allowing the package to compress or conform to the highly tensioned strap and allowing relative movement between the package and the machine so that the tension applied to the strap is more uniform throughout the loop.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same, FIG. 1 is a perspective view of a preferred embodiment of the apparatus of the present invention;

FIG. 7 is a partial, side view taken along the plane 7—7 of FIG. 6 with certain portions of the apparatus cut away to show interior parts;

DESCRIPTION OF THE PREFERRED EMBODIMENT

Figure 2:
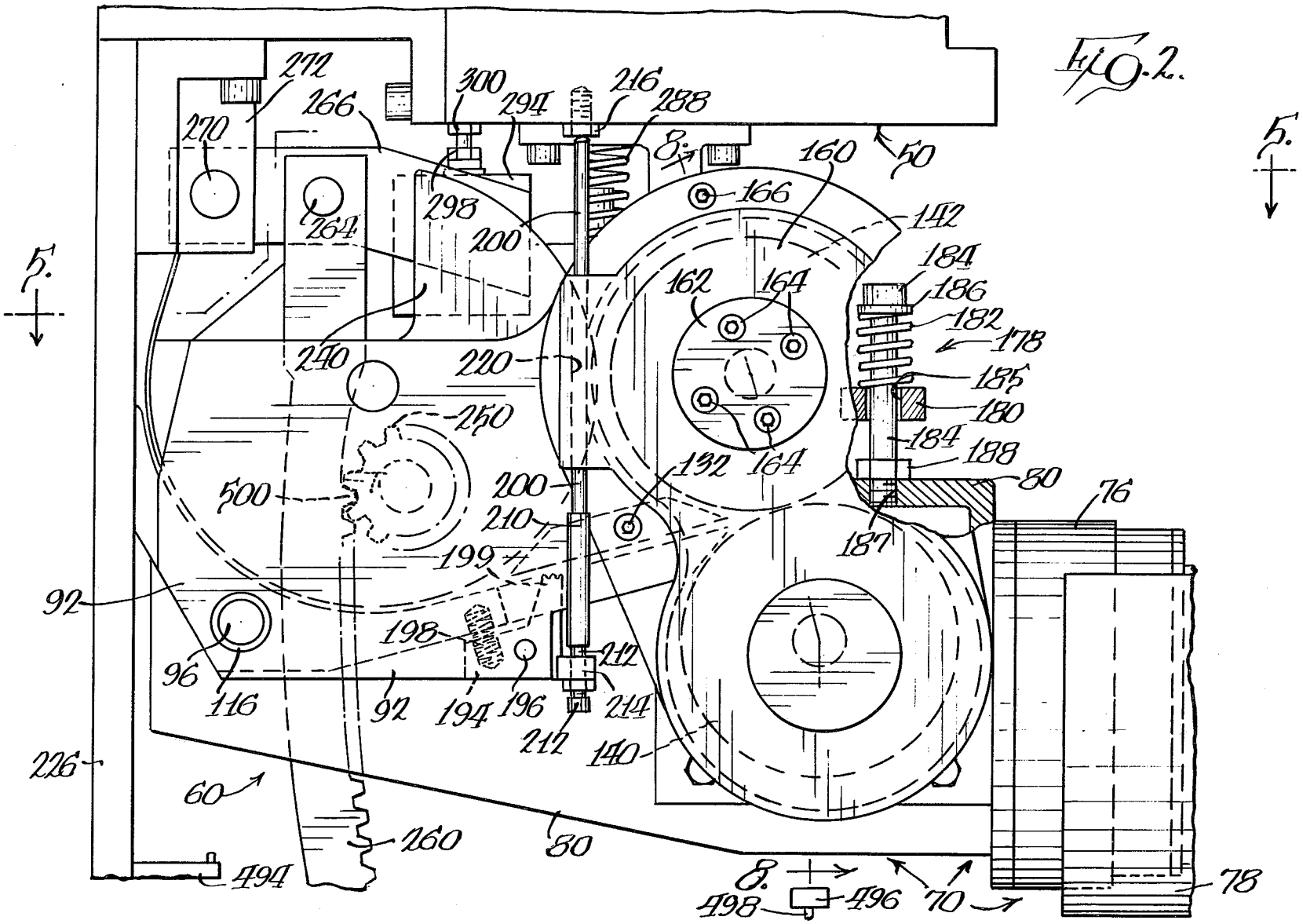
FIG. 2 is a partial side view of the apparatus with certain portions of the apparatus cut away to show interior parts.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to an embodiment which is simple and straightforward.

For ease of description, the apparatus of this invention will be described in its normal operating position, and terms such as upper, lower, horizontal, etc., will be used with reference to this normal operating position. It will be understood, however, that an apparatus of this invention may be manufactured, stored, transported and sold in orientation other than the normal operating position described.

The apparatus of this invention has certain conventional drive mechanisms and control mechanisms the details of which, though not fully illustrated or described, will be apparent to those having skill in the art and an understanding of the necessary functions of such drive mechanisms.

The strap feeding and tensioning assembly is preferably used in a strapping machine 20 which may be typically set up as illustrated in FIG. 1. A base frame 30 is provided to support, in proper orientation, three major components of the strapping machine.

One component is the spool or reel 34 on which is wound a supply of strap 36, and which is mounted for rotation about a horizontal axle 38 supported by post 40.

A second major component of the strapping machine is the strap chute 44 which is a ring-like structure supported by post 46 and serves to guide the strap 36 around its periphery to encircle a package (not shown) which may be placed within the strap chute 44. The package can be moved into the strap chute 44 by hand or automatically by suitable conveyor means (not shown).

A third major component of the strapping machine is the strap gripping and sealing unit 50 which is supported on either side by posts 52 and 54. The individual mechanical and electrical components comprising the strap gripping and sealing unit 50 are typically enclosed within a sheet metal housing 56 to protect the individual components from ambient environmental conditions, to protect personnel from electrical and moving parts, and to provide a pleasing appearance.

The particular arrangement, illustrated in FIG. 1, of the major components (the strap chute 44, the strap gripping and sealing unit 50, and the strap reel 34) is well known in the strapping art. Such an arrangement can be used with metal strap, with plastic strap, and with plastic-coated metal strap.

The novel strap feeding and tensioning assembly 60 of the present invention is preferably located below the gripping and sealing assembly 50 and may be enclosed with a housing 62. Preferably, the feeding and tensioning assembly 60 of the present invention is a substantially self-contained unit which may be quickly and easily mounted to the strapping machine frame and/or gripping and sealing assembly 50. It is contemplated that the means for mounting the feeding and tensioning assembly 60 to the strapping machine would enable the assembly 60 to be quickly and easily removed for maintenance and/or replacement with little or no disturbance of the other strapping machine components as will be explained in detail hereinafter.

In general, the strap 36 is fed through the strap feeding and tensioning assembly 60 into the strap chute 44 so that the free end of the strap 36 travels completely around the chute and overlaps a portion of the strap to form the loop. Then, the free end of the strap is gripped and the trailing portion of the strap is pulled, by appropriate mechanisms within the feeding and tension assembly 60, to tighten the loop about a package with a certain pre-tension and subsequently with a final, high tension. The mechanisms for effecting the feeding and tensioning will be described in detail hereinafter.

Next, the overlapped portions of the strap loop may be joined by any one of a number of well-known methods and the trailing portion of the strap can be severed from the loop so that the strap package can be removed from the chute 44. Depending upon the particular type of mechanisms used in the strap gripping and sealing unit 50, it is possible to form many types of joints between overlapped strap portions, including (1) an independent, metallic crimped or notched seal applied to metal strap; (2) an interlocking slit-type joint which is notched into metal strap; and (3) a heat fused joint in a plastic strap effected by friction through high frequency vibratory members or effected by direct contact with a heated member.

The operations wherein the strap free end is gripped and wherein the overlapping ends are sealed are typically performed at the front of the gripping and sealing unit 50 in the region indicated by the dashed box 66 in FIG. 1. The gripping and sealing unit 50, and the particular structure associated with the gripping and sealing region 66, could be any of a number of types well known to those skilled in the art. The gripping and sealing unit 50, as well as the strap chute 44 and the spool 34, form no part of the present invention and will not further be described. Thus, for the most part, the balance of the description of the embodiments of the apparatus of the present invention will be confined to the mechanisms in the feeding and tensioning assembly 60.

High Tension Strap Guide Arm—General Configuration

Figure 3:
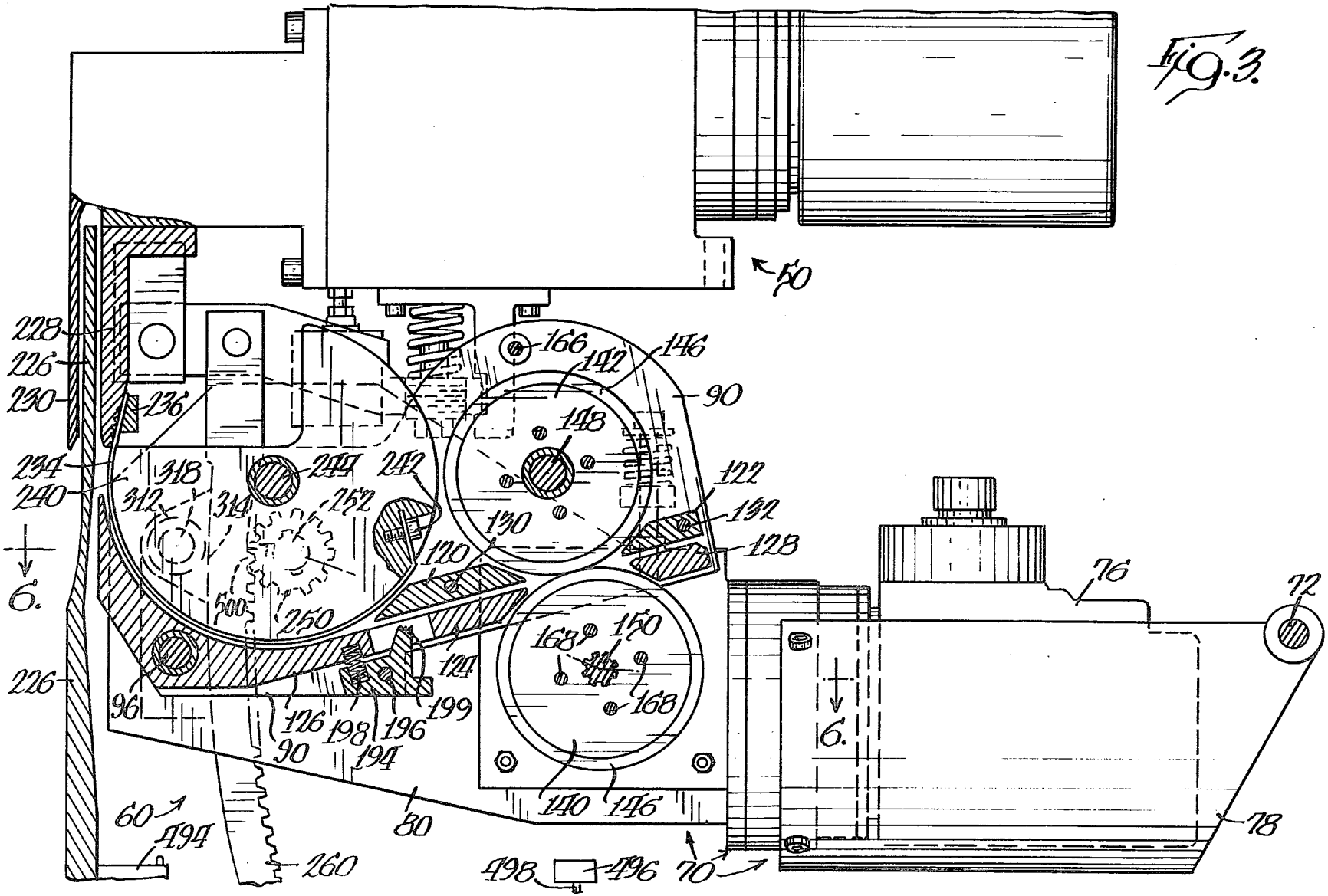
FIG. 3 is a partial, cross-sectional side view of the apparatus with the guide arm in the first, upper position.
Figure 4:
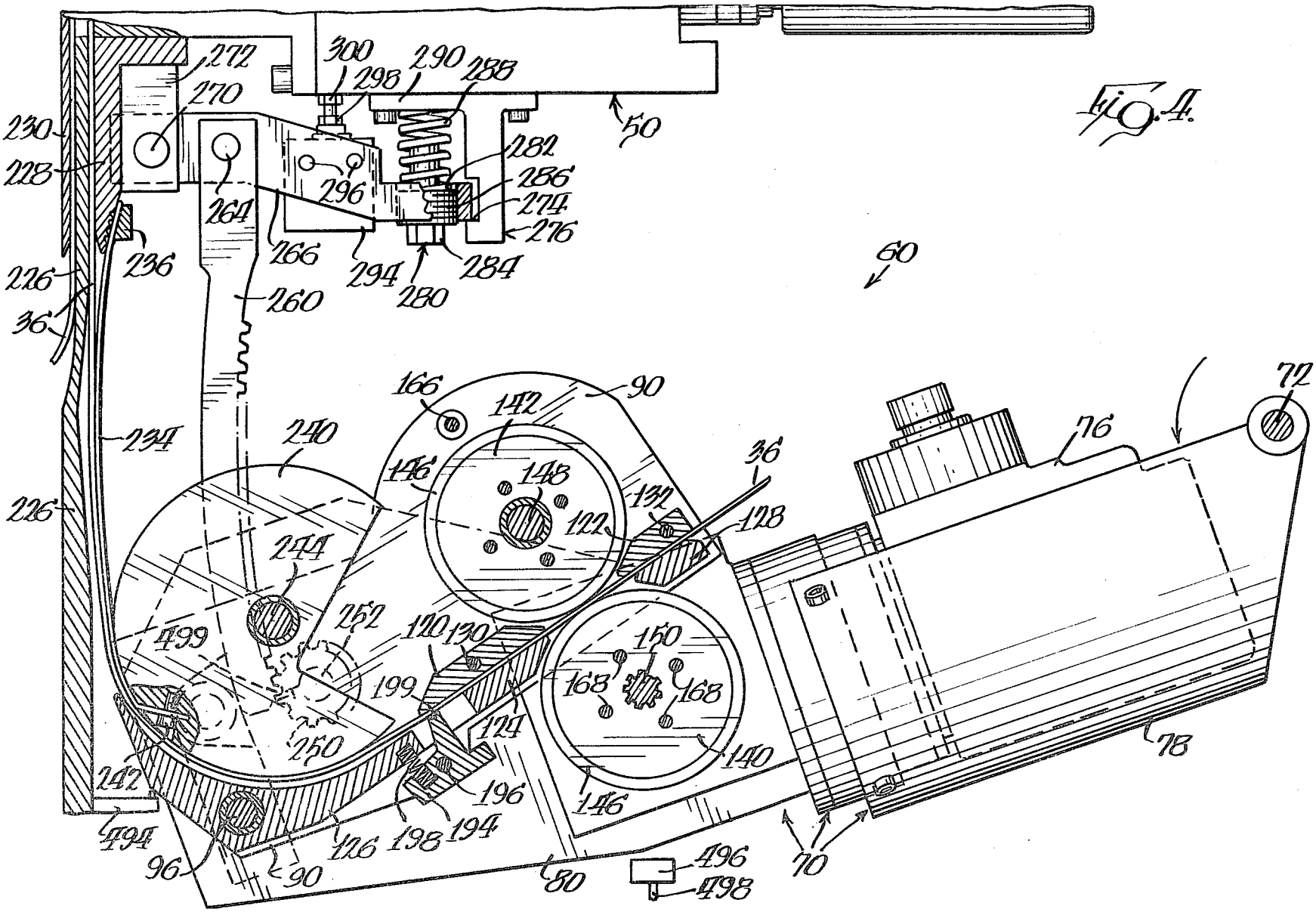
FIG. 4 is a view similar to FIG. 3 but showing the guide arm in the second, lower position.

FIGS. 3 and 4 illustrate the feeding and tensioning assembly 60 wherein the housing 62, which may be optionally provided to furnish protection of the assembly and provide a pleasing appearance, has been removed. The feeding and tensioning assembly 60 is positioned immediately below the gripping and sealing assembly 50 and has a strap guide arm means or high tension arm 70 which is pivotably supported on the rear end by a fixed axle 72, which axle 72 may be supported by any suitable means so that it is fixed relative to the other strapping machine components such as the gripping and sealing unit 50. For example, the axle 72 may be supported by a machine frame member or by housing 62 which may in turn be supported by gripping and sealing unit 50.

The high tension arm 70 consists of a number of subassemblies or mechanisms, described in detail hereinafter, which are bolted, or otherwise connected together to form a generally rigid arm capable of being rotated about axle 72 from a first, upper position illustrated in FIG. 3 to a second, lower position illustrated in FIG. 4 by a high tensioning mechanism described in detail hereinafter.

Motor and Gear Housing

With reference to FIG. 4, a single reversible electric motor 76 is provided and protected within a support cradle 78 which is journaled about axle 72. The motor 76 operates the mechanisms for feeding and pre-tensioning the strap and for applying high tension as will be explained hereinafter. Rigidly connected to the housing of the motor 76 and to cradle 78, and extending forwardly therefrom, is gear housing 80 which contains the novel gear drive assembly to be described in detail hereinafter with reference to other figures.

Strap Side Guides

Figure 5:
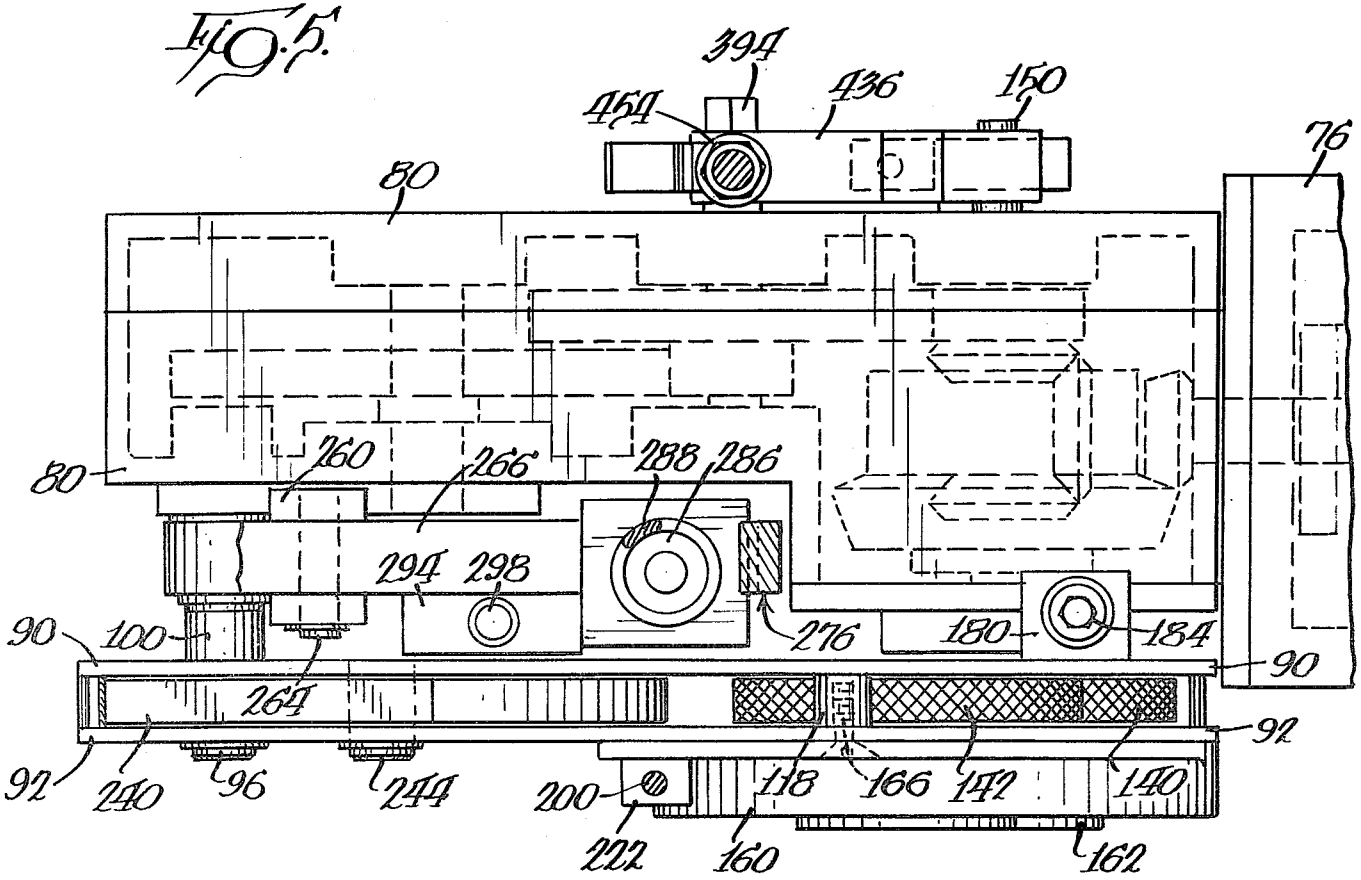
FIG. 5 is a partial cross-sectional plan view taken generally along the plane 5—5 of FIG. 2.
Figure 6:
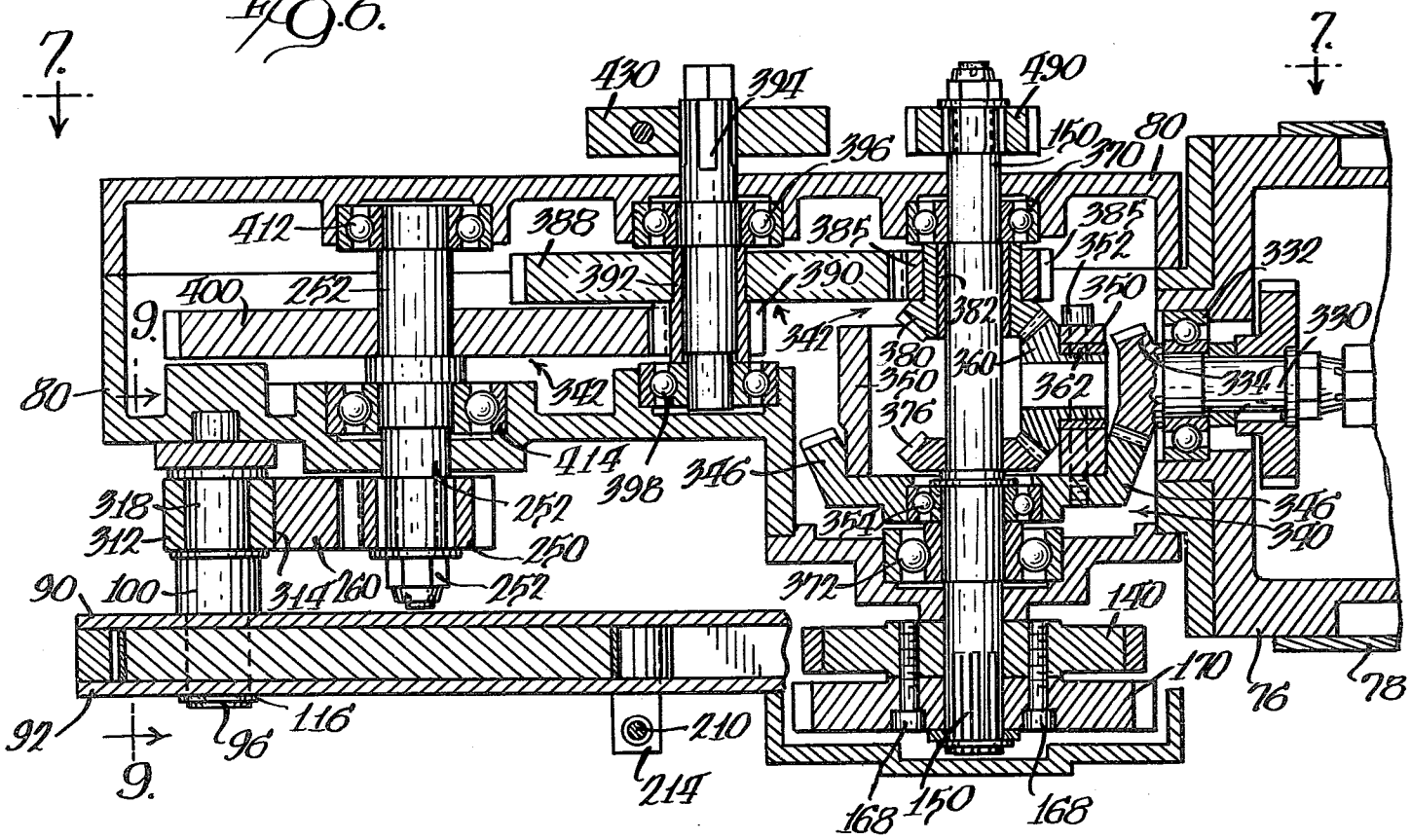
FIG. 6 is a reduced, partial cross-sectional plan view taken generally along the plane 6—6 of FIG. 3.

For guiding the strap through the high tension arm 70, a pair of spaced apart side guides 90 and 92 are mounted on one side of the gear housing 80 as best illustrated in FIGS. 5 and 6. FIGS. 3 and 4 show side guide 92 removed to furnish a side view of side guide 90. FIG. 2 shows side guide 92 in place.

Figure 9:
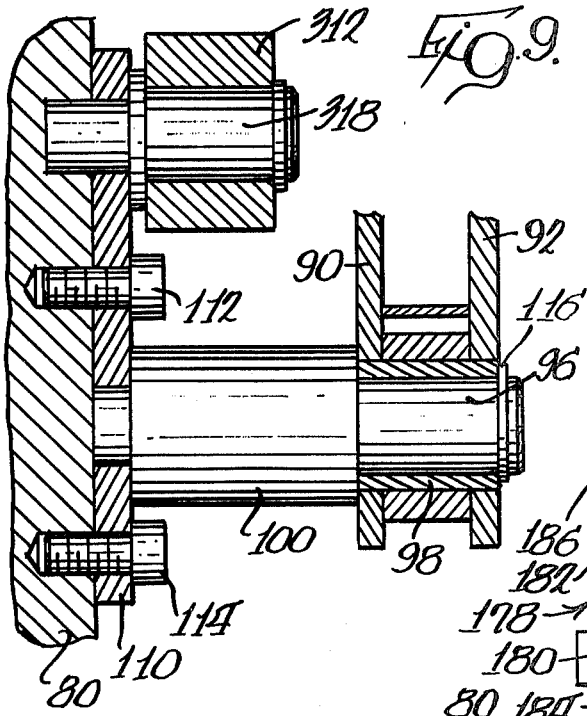
FIG. 9 is a partial, cross-sectional view taken generally along the plane 9—9 of FIG. 6.

Both side guides 90 and 92 are pivotably mounted about axle 96 on a sleeve bearing 98. The axle 96 is mounted to a portion of gear housing 80 as best illustrated in FIGS. 6 and 9. The shaft 96 has an integrally formed, larger diameter base portion 100 which bears against the side of side guide 90 and which is welded to a mounting plate 110, which plate 110 is bolted to gear housing 80 with bolts 112 and 114 as best illustrated in FIG. 9. A retaining ring 116 (FIGS. 2, 6, and 9) is mounted in an annular groove near the distal end of axle or shaft 96 for bearing against the outer side guide 92 and maintaining the side guides on the shaft 96. The side guides 90 and 92 are rotatable about the shaft 96, within a small angular range, to provide appropriate traction wheel force on the strap as will be explained in detail hereinafter.

The side guides are maintained in a spaced apart parallel relationship by spacers, such as spacer 118 (FIG. 8), by upper strap guides 120 and 122 and by lower strap guides 124, 126, and 128 (FIG. 3). The side guides 90 and 92 are secured together with machine screws, such as screws 130 and 132 passing through upper strap guides 120 and 122, respectively.

The upper and lower strap guides, in addition to maintaining the side guides 90 and 92 in the proper, spaced apart relationship, serve to contact the top and bottom surfaces of the strap 36 and properly guide the strap 36 between the side guides 90 and 92. The strap 36, illustrated in FIG. 4 only, enters a channel formed between upper strap guide 122 and lower strap guide 128 and moves from right to left during feeding so that the strap then passes between opposed guides 120 and 124 and along curved guide 126 out of the front end of the arm 70 and eventually into the strap chute.

Traction Wheels

The strap is pulled through the strap guides during feeding, and is retracted through the strap guides during the pre-tensioning sequence by traction wheels 140 and 142 (FIGS. 3, 4, and 8) which are located on opposite sides of the strap and which compress the strap slightly therebetween. Preferably, the traction wheels have a peripheral annular layer of urethane 146 which provides adequate traction without damaging the strap. The urethane is also resistant to undergoing a permanent deformation and forming unwanted flat spots.

Figure 8:
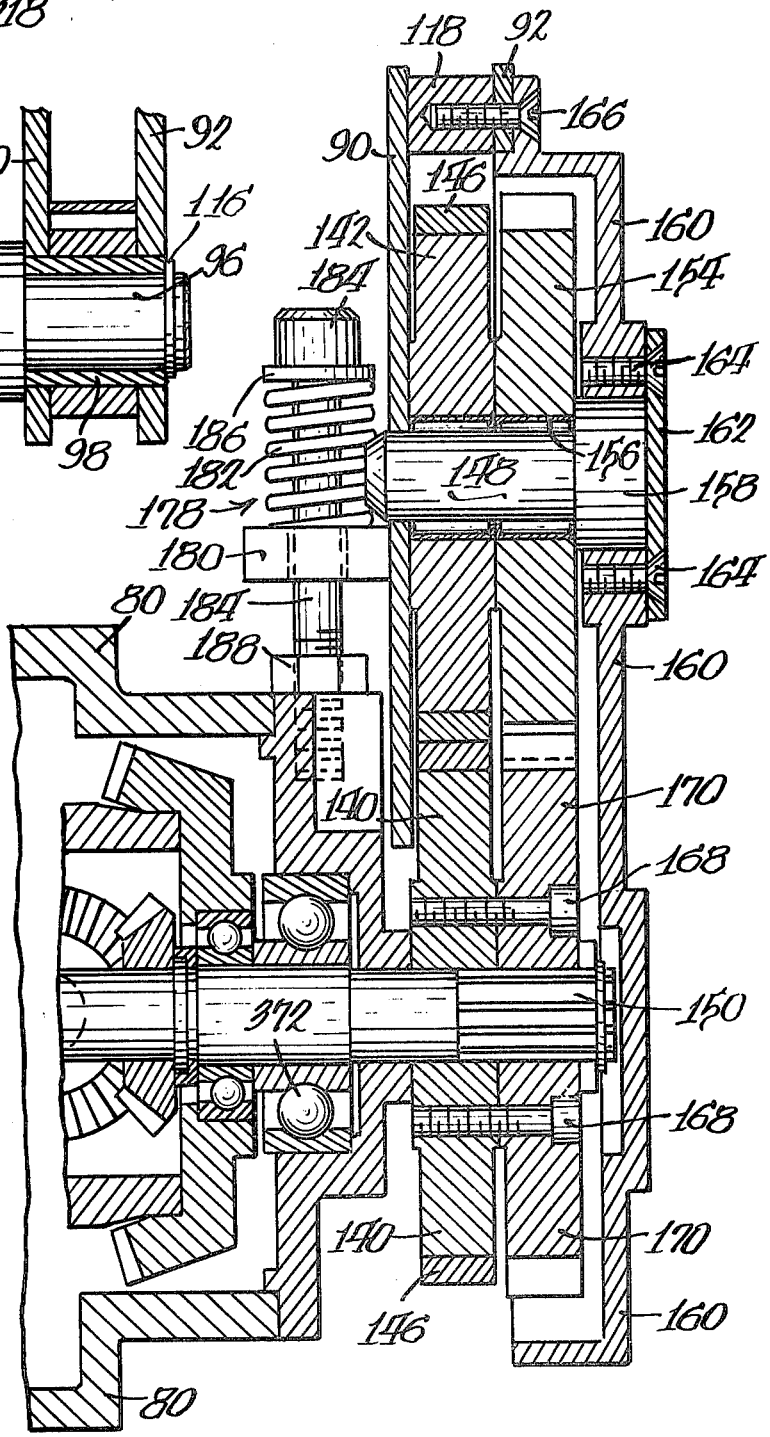
FIG. 8 is an enlarged, partial cross-sectional view taken generally along the plane 8—8 of FIG. 2.

The upper traction wheel 142 is mounted for rotation on, and relative to, shaft 148 and the lower traction wheel 140 is mounted for rotation with shaft 150 as best illustrated in FIG. 8. The upper wheel 142 is bolted (bolts not illustrated) to an upper traction wheel gear 154 which is also mounted for rotation on, and relative to, shaft 148. Both gear 154 and the traction wheel 142 rotate on a bearing 156 about shaft 148. The outboard end of shaft 148 has an enlarged diameter portion 158 which is disposed within a traction wheel cover 160. A circular cover plate 162 is secured to cover 160 with screws 164 for holding the shaft 148 in position. The inboard end of shaft 148 is mounted in the inner side guide 90 as illustrated in FIG. 8. The cover 160 is secured to the outer side guide 92 with appropriate screws, such as screw 166, illustrated in FIGS. 2 and 8. The cover 160 extends downwardly and also covers the end of shaft 150.

The lower traction wheel 140 is secured, as by machine screws 168, to a drive gear 170 which is splined to the outboard end of shaft 150. Gear 170 thus rotates with shaft 150, rotating with it the lower traction wheel 140. Gear 170 also meshes with gear 154 to rotate gear 154 and hence upper traction wheel 142 bolted to gear 154.

It is to be noted that although the upper gear 154 and the upper traction wheel 142 bolted thereto are mounted on shaft 148 in fixed relation to the side guides 90 and 92 and to the cover 160, this is not the case with the lower gear 170 and the lower traction wheel 140. Specifically, the shaft 150 is not carried in or by the side guides 90 and 92. Rather, shaft 150 is journaled in, and carried by, bearing 372 in gear housing 80 as best illustrated in FIG. 8. The side guides 90 and 92, as previously explained, are pivotably mounted about shaft 96 to housing 80 (see FIGS. 2, 3, 5, and 9) and are thus free to pivot downwardly, carrying with them shaft 148, traction wheel 142, gear 154, and cover 160 towards the lower traction wheel 140 and lower gear 170.

The upper gear 154 and upper traction wheel 142 are maintained in proper orientation with respect to the lower gear 170 and traction wheel 140 by an adjustable support assembly 178 best illustrated in FIGS. 2 and 8. Specifically, a lug 180 is welded to the inner side guide 90 and supports a spring 182 which is maintained in compression against lug 180 by a bolt 184 acting against the top of spring 182 through washer 186. The bolt 184 passes through an aperture 185 and is threadingly engaged in a receiving aperture 187 in the gear housing 80. With reference to FIG. 2, it is seen that the spring 182 bears against lug 180 and causes the side guide 90 (and the attached guide 92 and cover 160) to rotate clockwise about shaft 96. This brings the upper traction wheel 142 closer to lower traction wheel 140 (see FIG. 8).

Even if the peripheral urethane layer 146 on the wheels 140 and 142 are in contact, they can be further compressed to effect a tighter compression therebetween, and hence a tighter traction on any strap lying therebetween. Of course, suitable clearance depth is provided in the gear teeth of gears 154 and 170 to permit the desired adjustable range. The apparatus is initially set up by rotating screw 184 which varies the force spring 182 exerts on lug 180 which then rotates side guides 90 and 92 about shaft 96 to provide the desired force between the feedwheels. This controls the amount of traction the wheels exert on the strap. A lock nut 188 on bolt 184 can be tightened down against the gear housing 80 to lock the adjusting screw 184.

Gripper

During the high tension sequence, the high tension strap guide arm 70 pivots downwardly (by mechanisms described hereinafter) to pull against the trailing portion of the strap. During this sequence, the trailing portion of the strap in the strap guide arm, specifically that portion passing in te channel defined by the upper and lower strap guides 120, 122, 124, 126 and 128, is gripped and held in fixed relationship with the guide arm 70 as the guide arm 70 pivots downwardly. To this end, a gripper means or gripper 194 is provided between side guides 90 and 92 and below the strap in an opening defined between lower strap guides 124 and 126 as best illustrated in FIG. 3. The gripper 194 is pivotally mounted about shaft 196 and is biased to rotate about shaft 196 in a counterclockwise direction by spring 198 which, on one end, is mounted in a receiving aperture in lower strap guide 126 and on the other end is mounted in a receiving aperture in the gripper 194. Thus, the spring 198, being under compression, urges the gripper against the strap as the strap passes between strap guides 120 and 124. Preferably, the gripper 194 has a plurality of gripping teeth 199 to provide a better gripping action on the strap.

During the strap feeding sequence and during the strap loop pre-tensioning sequence, the strap must be free to move forwardly and rearwardly, respectively, through the strap guide arm 70. To this end, the gripper 194 is rotated so that the teeth 199 are not contacting the strap by a spacer rod 200 disposed between the gripper 194 and the bottom of the gripping and sealing unit 50 as best illustrated in FIGS. 2 and 5.

The rod 200 has an enlarged cylindrical portion 210 on the bottom end for bearing against an adjustable set screw 212 which is threadingly mounted in a lug 214 projecting from gripper 194. The top end of the rod 200 is adapted to abut an adjustable set screw 216 which is threadingly received in a fixed portion of the strapping machine or machine frame, such as the bottom of the gripping and sealing unit 50. The rod 200 is slidably disposed within a cylindrical channel 220 in an extension portion 222 of the traction wheel cover 160. The rod is thus free to slide vertically, as viewed in FIG. 2, within channel 220, under the influence of gravity, when the strap guide arm 70 is rotated downwardy to the second, lower arm position illustrated in FIG. 4. The gripper biasing spring 198 is sized to overcome the weight of the rod 200 when the strap guide arm 70 pivots downwardly and to rotate gripper 194 upwardly so that the gripper teeth 199 are forced into contact with the strap 36 and so that the strap is consequently forced by the gripper teeth 199 against the surface of the upper strap guide 120 whereby the strap is prevented from slipping past the strap guide 120 and through the strap guide arm 70 as the strap guide arm 70 is pivoted downwardly to apply high tension to the strap loop. After the high tension sequence has been completed, and after the strap guide arm 70 has returned to the first, upper position, the upper end of the rod 200 abuts the screw 216 and forces the gripper 194 to rotate clockwise about the shaft 196, thereby disengaging the gripper from the strap.

Extensible Strap Guide

When the high tension guide arm 70 is pivoted downwardly to pull the gripped strap and apply high tension to the loop, a novel means is provided for guiding the strap at the front end of the high tension guide arm 70.

FIG. 4 illustrates the high tension guide arm 70 in the lowered, second position with the strap 36 passing therethrough and out of the front end up into a strap channel in the strapping machine frame defined between a middle guide member 226 and rear guide member 228.

The front end of the high tension arm 70 is spaced inwardly of the strapping machine middle guide member 226 so that the strap 36 impinges upon member 226 and is guided upwardly into the strapping machine between guide member 226 and the rear member 228. The strap continues through the gripping and sealing region 66 (FIG. 1) of the gripping and sealing unit 50 and then around the chute 44 where it returns and passes between the middle guide member 226 and a front guide member 230 as illustrated in FIG. 4.

With reference to FIGS. 3 and 4, the strap 36 is guided on one side at the front end of the high tension arm 70 by an extensible strap guide or metal clock spring band 234. As illustrated in FIG. 3, band 234 is held at one end between rear guide member 228 and a block 236 and at the other end in a strap guide wheel 240 by a screw 242 which passes through a receiving aperture in the end of the band 234 and is threadingly engaged in a suitable aperture in the strap guide wheel 240. The strap guide wheel 240 is mounted for rotation about shaft 244 between the side guides 90 and 92 as best seen in FIG. 5. When the strap guide arm 70 is in the first, upper position illustrated in FIG. 3, the clock spring metal band 234 wraps around a substantial portion of the periphery of the wheel 240 and, owing to the spring stiffness of the band, biases the strap guide wheel 240 in a counterclockwise direction about shaft 244 so that the clockspring band 234 is in intimate contact with the peripheral surface of the strap guide wheel 240 for most of its length. In this position, the strap passing through the strap guide arm 70 is guided by lower guide member 126 on one side surface and by the clockspring metal band 234 on the other side surface.

When the strap guide arm 70 is pivoted to the second (lower), high tensioning position (by means explained hereinafter), the strap guide wheel 240 is rotated in a clockwise direction by the clockspring band 234 so that the clockspring band 234 "unwinds" from the peripheral surface of the strap guide wheel 240 to assume the configuration illustrated in FIG. 4. In this manner, the clockspring metal band 234 forms a continuous guide on the inner side of the strap 36 as the strap 36 extends from the bottom of the strap gripping and sealing unit 50 to the lowered front end of the high tension strap guide arm 70.

When the strap guide arm 70 is moved upwardly and returned to the first, upper position, the spring stiffness of the clockspring metal band 234 causes the strap guide wheel 240 to rotate counterclockwise so that the band 234 again winds itself about the peripheral surface of the strap guide wheel 240. In this manner, the strap 36 is continuously guided and supported during and after the high tensioning sequence.

In some applications, it is preferable to replace the clockspring type of extensible strap guide described above with an alternate form of a guide assembly. Specifically, a tube could be provided to extend upwardly from the end of the high tension arm 70 and be received in the strap guideway between members 226 and 228 at the front of the machine. The tube would be long enough so that when the high tension arm moved to its furthest downwardly pivoted position (as in FIG. 4), a portion of the upper end of the tube would still be retained within the strap guideway. In this manner, the strap is contained within the tube through all positions of the high tension arm. Such a tube type of strap guide is described and illustrated in the co-pending patent application entitled "Method and Apparatus for Binding an Article With a Loop of Tensioned Strap," Ser. No. 835,647, filed by the inventors of the subject invention, and attention is directed thereto for further details (see specifically the references to element 170 on pgs. 30 and 37 thereof).

High Tension Drive Member and High Tension Reaction Means

A novel system is used for pivoting the high tension strap guide arm 70 downwardly during the high tension sequence. Specifically, with reference to FIGS. 3 and 4, a high tension drive member or pinion gear 250 is mounted for rotation about an axis or shaft 252 which is fixed relative to, and movable with, the pivotable high tension strap guide arm 70 which is adapted for engaging a high tension reaction means or toothed rack 260. Rotation of the pinion 250, by drive mechanisms to be described hereinafter, causes the pinion to move upwardly or downwardly along rack 260 and to carry with it the entire high tension strap guide arm 70, which guide arm pivots about the shaft 72 described above in the section entitled, "High Tension Strap Guide Arm—General Configuration."

The rack 260 is pivotably connected, through an intermediate member, to a portion of the strapping machine frame which is fixed relative to the pivotable high tension strap guide arm 70. Specifically, in the embodiment illustrated in FIG. 4, the rack 260 is pivotably mounted at its upper end about a shaft 264 to a tension sensing lever 266, which lever 266 is in turn pivotably mounted about a shaft 270 to a block 272 on the strapping machine frame.

The high tension sensing lever 266 is held in place on its distal end by a shoulder 274 cut into a block 276 which is secured to the strapping machine or, specifically, to the underside of the gripping and sealing unit 50. The shoulder prevents the high tension sensing lever 266 from rotating in the clockwise direction about shaft 270 beyond the point illustrated in FIG. 4. A special adjusting bolt 280 is disposed within a receiving aperture 282 near the distal end of the high tension sensing lever 266. The bolt 280 has a head 284 adapted for being easily turned by a wrench and further has an enlarged, cylindrical, threaded portion 286 which is threadingly engaged with the sides of the aperture 282. A spring 288 is disposed between a mounting flange 290 of block 276 and the enlarged cylindrical portion 286 so as to bias the high tension sensing lever 266 clockwise about shaft 270 and into engagement with the shoulder 274 in block 276. The biasing force of spring 288 can be adjusted by turning bolt 280.

A limit switch 294 is secured to high tension sensing lever 266 by screws 296 and is adapted to contact the head of a bolt 298 which is threadingly engaged in a nut 300 mounted to the underside of the gripping and sealing unit 50. When the high tension strap guide arm 70 is in the first, upper position as illustrated in FIGS. 2 and 3, a spring 288 biases the high tension sensing lever 266 against shoulder 274 whereby the limit switch 294 is spaced away from the head of bolt 298 by an amount sufficient to maintain the limit switch electrical contact in the "shelf" position. When the high tension strap guide arm 70 is moved downwardly (to apply high tension during the high tensioning sequence) by the pinion gear 250 rotating downwardly along the rack 260, the reaction force is transmitted upwardly through rack 260 into the high tension sensing lever 266. This forces the high tension sensing lever 266 upwardly off of shoulder 274 in support block 276 and against spring 288. At a certain point, the reaction force transmitted from the rack 260 is great enough to force the limit switch 294 against the head of the bolt 298 to thereby actuate the switch. Switch 294 is connected in the electric circuit for the motor 76 to reverse the motor direction for rotating the pinion 250 in the counterclockwise direction (as viewed in FIGS. 3 and 4). Motor reversal occurs only after a predetermined time delay during which the strap joint can be formed. Thereafter, the pinion 250 rotates up the rack and returns the high tension strap guide arm 70 to the first, upper position illustrated in FIG. 3.

To maintain the pivoting rack 260 in proper engagement with the teeth on pinion gear 250, a novel bearing means is provided which prevents the rack 260 from being forced outwardly of, and away from, the pinion gear 250. The bearing means comprises a bronze bearing block 312 which is best illustrated in phantom in the side elevation view of FIG. 3, in the front elevation view of FIG. 9, and in the top cross-sectional view of FIG. 6. The block 312 is mounted for rotation about shaft 318 and has a generally rounded triangular prism shape with a flat bearing surface 314 for bearing against the back of rack 260. The shaft mounting of block 312 permits the block to rotate slightly clockwise or counterclockwise to accommodate the curvature and swinging movement of the rack 260 as the high tension strap guide arm 70 moves upwardly or downwardly along the rack.

Gear Drive Assembly

The single, reversible electric motor 76 associated with the novel strap feeding and tensioning apparatus 60 of the present invention drives the traction wheels 140 and 142 to both feed and subsequently pre-tension the strap and further drives the pinion gear 250 to pivot the high tension strap guide arm 70 to apply high tension (FIG. 4). A novel gear drive assembly means is provided for properly engaging the motor with the traction wheels or the pinion gear as required. The gear drive assembly is best illustrated in a cross-sectional plan view in FIG. 6. The gear drive assembly is mounted within the gear housing 80 which is secured on one end to the casing of motor 76 and to the cradle 78.

The motor 76 has an output drive shaft 330 mounted for rotation in bearing 322 which is held in one end of the casing of motor 76. Shaft 300 projects into gear housing 80 and has, integral with this end, a bevel drive gear 334. The bevel drive gear 334 is engaged with a differential gear subassembly 340 for transmitting the motor power to either the traction wheels through shaft 150 or to the pinion gear 250 through its shaft 252 and a train of reduction gears 342 as will be explained in detail below.

The differential 340 comprises, in part, a large bevel gear 346 which is driven by motor drive shaft gear 334 and to which is secured cylindrical differential housing or cage 350. The cylindrical differential housing 350 is secured to the large bevel gear 346 by bolts 352, one of which is illustrated in phantom in FIG. 6. Differential housing 350 thus rotates with large bevel gear 346. Large bevel gear 346 is mounted on traction wheel drive shaft 150 for rotation relative thereto by means of bearing 354. Thus, large bevel gear 346, and the differential cylindrical housing 350 secured thereto, can and do rotate at all times when the electric motor shaft 330 is rotating.

Mounted within the cylindrical differential housing 350 are three beveled pinion gears 360, one of which is visible in FIG. 6. The three pinion gears 360 are disposed about the cylindrical differential housing at 120° spacings. Therefore, with reference to FIG. 6, one of the other two unillustrated pinion gears is below the plane of the figure and the other of the two unillustrated pinion gears is above the plane of the figure. Each pinion gear 360 is mounted for rotation in a bearing 362.

The traction wheel shaft 150 is mounted in the gear housing 80 on one end by means of bearing 370 and on the other end by means of bearing 372 (FIGS. 6 and 8). Within the cylindrical differential housing 350 another bevel gear 376 is secured to shaft 150 for rotation therewith and is drivably engaged with the three differential pinion gears 360. Gear 376 can thus rotate the traction wheel drive shaft 150 when the differential 350 is being driven through bevel gear 346 by motor 76.

On the end of the cylindrical different housing 350, opposite the gear 376, is another bevel gear 380 which is mounted about traction wheel shaft 150 on a bearing 382 for rotation relative thereto. Integral with gear 380 is an exterior gear 385 from which the high tension pinion 250 is eventually driven as will next be explained.

The rotating cylindrical differential assembly 350, and the pinion gears 360 carried thereby, also rotate bevel gear 380 and its exterior gear 385, independently of shaft 150, to drive the train of reduction gears 342. Specifically, reduction gear train 342 includes gears 388 and 390 fixed to sleeve 392 which is fixed to a shaft 394 so that both gears 388 and 390 rotate with shaft 394. Shaft 394 is journaled within gear housing 80 is bearings 396 and 398. Gear 388 is meshed with, and driven by, gear 385. Adjacent gear 390, a gear 400 is fixedly mounted to the pinion shaft 252, which shaft is journaled in the gear housing 80 in bearings 412 and 414. Gear 400 is meshed with gear 390 for being driven thereby. The rotation of gear 400 causes shaft 252 to rotate and to thereby rotate the high tension drive member or pinion 250 which is mounted thereon as previously described.

The reduction gear train assembly 342, comprising gears 385, 388, 390 and 400, reduced the speed of the shaft 252 to a suitably low level for applying high tension. Specifically, as discussed above under the sections entitled "Background of the Invention" and "Summary of the Invention," it is desirable that the strap be tightened about the package in the high tensioning sequence at a relatively low speed so that the package can be compressed with the highly tensioned strap and so that relative movement between the machine and the package is easily accommodated to effect a more uniform tension throughout the strap loop. On the other hand, however, it is noted that the traction wheel drive shaft 150 rotates at a much greater speed than the pinion shaft 252 owing to the lack of a similar reduction gear system. Consequently, the traction wheels are rotated at a relatively high speed for rapid feeding of the strap and, when the motor rotation is reversed, for relatively rapid pre-tensioning.

Obviously, during feeding of the strap, or during the pre-tensioning of the strap loop, application of high tension by the pinion 250 engaged with rack 260 is not desired. Therefore, a novel mechanism is used according to the present invention to prevent the pinion gear 250 from rotating when the traction wheels are being rotated. Likewise, the present invention includes another novel mechanism for positively locking or preventing rotation of the traction wheels when the high tension pinion 250 is rotated during the high tensioning sequence. In some applications, this feature may be desirable. These novel mechanisms will be explained next.

Pinion Gear and Traction Wheel Latch Mechanisms

During a normal strapping cycle, the traction wheels are rotated to first feed the strap through the strap chute and to form a loop about the package. In the apparatus of the present invention, shaft 150 is driven through the differential 340 to drive the traction wheels to feed the strap. Specifically, with reference to FIG. 3, shaft 150 is rotated in a counterclockwise direction to cause lower traction wheel 140 to rotate in a counterclockwise direction and to cause upper traction wheel 142, driven through gears 170 and 154, to rotate in the clockwise direction.

When shaft 150 is rotating in the counterclockwise direction to feed the strap, the cylindrical differential housing and large bevel gear 346 must necessarily be rotating in the counterclockwise direction. To drive the differential bevel gear 346 in the counterclockwise direction for strap feeding, the gear 334 and motor shaft 330 must be rotating in a counterclockwise direction (when viewed in the plane of FIG. 6 while looking towards the motor 76). During strap feeding, to prevent the gear reduction train 342 from being rotated by the differential 340 to cause rotation of the high tension pinion 250, a latch mechanism is provided as best illustrated in FIG. 7.

In the reduction gear train 342, the shaft 394 has on its distal end, and outwardly of the gear housing 80, a latch cam 430 which is mounted on, and splined to, the shaft 394. The latch cam 430 is a split disc which is compressed about the shaft 394 with bolt 431. The cam 430 has a recessed bearing notch 432 for receiving a roller member 434 which is mounted on one end of an arm 436 on shaft 435. Arm 436 is pivotably mounted to the side of gear housing 80 about shaft 438.

An adjustable, spring-biased, hollow cylindrical bearing member 444, having a hemispherical bearing portion 446 on one end, is provided for seating within a hemispherical receiving seat 448 on arm 436 and for holding the arm 436 so that roller 434 engages cam 430 and prevents the rotation thereof.

Member 444 is mounted by means of a bolt 452 on one end to another bolt 454, which bolt 454 is mounted to a projecting lug 456 on the bottom of the gripping and sealing unit 50. A spring 458 is compressibly disposed between the end of bolt 454 and the upper side of the spherical bearing portion 446 to hold the spherical bearing portion 446 against the arm 436. The spring bias or compression force can be adjusted by varying the thread engagement between bolt 452 and 454.

Cam 430 cannot rotate in the counterclockwise direction as viewed in FIG. 7 because of the relationship between the shafts 438, 435, and 394 as the bearing notch 432 bears against roller 434. Since cam 430 cannot rotate counterclockwise, as viewed in FIG. 7, shaft 394 likewise cannot rotate counterclockwise, which is the direction in which shaft 394 could otherwise be rotated by the differential 340 and gear 385 when the electric motor 76 was rotating in the direction to rotate the traction wheels to feed the strap into the strap chute. Thus, the entire train of reduction gears 342 is locked against rotation and the high tension pinion 250 cannot rotate.

When the electric motor is reversed to pull the strap tight about the package during the pre-tensioning sequence, the shaft 394 will tend to be rotated in the clockwise direction as viewed in FIG. 7. In this direction, the bearing notch 432 can force roller 434 upwardly and out of engagement with the cam 430.

The amount of pre-tension drawn by the traction wheels can be set by adjusting the compression force of spring 458. Specifically, when the traction wheels have drawn a predetermined amount of pre-tension on the strap, the force being transmitted through the differential 340 and gears 382, 385, and 388 to shaft 394 will cause the cam 430 to rotate clockwise (FIG. 7) and move the roller 434 and arm 436 upwardly against the spring 458 to the position illustrated in FIG. 7 by dashed lines. In this position, the cam 430 is then free to rotate and shaft 394 thus rotates, turning driving gear 400, shaft 252, and finally pinion gear 250 to initiate the high tension sequence. The point at which this occurs, i.e., the desired pre-tension level, is set by adjusting the compression of spring 458 through bolt 452.

As the pinion 250 rotates, it rotates in engagement downwardly along rack 260 and the entire strap guide arm 70 pivots downwardly as illustrated in FIG. 4. As soon as the strap guide arm 70 has pivoted out of or away from the first, upper position illustrated in FIG. 3, the notch 432 of cam 430 is completely out of engagement with roller 434 on arm 436. With reference to FIG. 7, it can be seen when the high tension arm 70 drops away during the high tensioning sequence, the member 444 is retained by the underside of the head of the stud 452 and cannot drop down to follow the high tension arm 70 and the lever 436 mounted thereon.

To prevent roller 434 from falling downwardly and re-engaging cam notch 432, a lever support assembly is provided. With reference to FIG. 7, the support assembly consists of a support rod 470 which is pivotably supported about shaft 472 on one end in a latch member 474 and which, on the other end, is received in an aperture 476 in lever 436. The latch 474 is pivotably mounted about shaft 478 to gear housing 80 and is biased in a counterclockwise direction about shaft 478 by spring 480 which is mounted on an upwardly projecting lug 482 from a portion of the gear housing 80. This forces the rod 470 slightly upwardly and holds lever 436 and roller 434 out of engagement with cam 430 when the high tensioning arm 70 is pivoted downwardly from the first, upper position during high tensioning. However, when the high tension arm is in the first, upper position as illustrated in FIGS. 2, 3, and 7, the rod 470 is forced by lever 436 to rotate latch 474 in a clockwise direction about shaft 478 and cause a further compression of spring 480.

Just before the initiation of the high tension sequence, the motor 76 is driving shaft 150, through the differential 340, to rotate the traction wheels 140 and 142 and draw tension in the strap. When the tension in the strap reaches a certain level, the torque in the differential 340 is great enough that the torque applied to the gear reduction train 342, acting through cam 430, overcomes the bias of the latch spring 459 so that the torque of the motor 76 is then preferentially transferred entirely to the pinion gear 250. With a suitable design of the gear reduction train 342, the rotation of the traction wheels terminates at this point because the reaction torque on the traction wheels from the tension in the strap is greater than the torque required to rotate the pinion gear 250.

Although not required in the preferred embodiment, it may be desirable in some applications to positively lock the traction wheels 140 and 142 against rotation in the strap tensioning direction when the high tension is applied by the pinion gear 250. To this end, a traction wheel latch comprising latch wheel 490 (FIG. 7) can be provided for cooperatively engaging latch 474 as will next be explained.

When the strap guide high tension arm 70 moves downwardly away from the first, upper position and when the lever 436 is held up by rod 470, spring 480 causes the latch 474 to rotate in a counterclockwise direction about shaft 478 and into engagement with the latch wheel 490. The latch wheel 490 is secured to traction wheel shaft 150 for rotation therewith. When the latch 474 engages the latch wheel 490, further rotation of the traction wheel shaft 150 is prevented and the traction wheel rotation immediately ceases. However, the motor still continues to drive the pinion gear 250 to move the high tensioning strap guide arm 70 downwardly because the motor 76 is driving the gear 380 (which is mounted for rotation on, and relative to, shaft 150) through the differential 340 to rotate the train of reduction gears 342.

Though not necessary in the preferred embodiment, after high tension has been applied and after the motor 76 has been reversed to rotate the pinion gear 250 up the rack 260, it may be desirable in some applications to continue to positively lock the traction wheels 140 and 142 against rotation, as with the above-described latch wheel 490 in cooperation with latch 474. This would assure that the traction wheels would not rotate and would not tend to feed the strap forward while the pinion gear was moving back up the rack. For, it the strap feed reel and traction wheels had less rotational resistance than the torque required to move the pinion up the rack (not the case in the preferred embodiment), then the traction wheels would be undesirable preferentially rotated instead of the pinion gear. Only when the high tensioning strap guide arm 70 has returned to its uppermost position (FIGS. 3 and 7) will the latch 474 be disengaged from latch wheel 490 to permit rotation of the traction wheels.

Such a latch wheel 490 is not required in the preferred embodiment however. That is, when the pinion gear 250 is rotated in the direction to move back up the rack 260 after applying high tension, the rotational resistance of the traction wheels in the direction of strap feed is still greater than the torque required to move the pinion gear up the rack. This rotational resistance of the traction wheels is really the cumulative effect of the rotational friction in the strap supply reel 34, in the traction wheel gears 154 and 170, and in the shaft 150, as well as of the reaction force produced in trying to push the gripped strap forward against the still closed gripper 194.

It is thus seen that a single, reversible electric motor (1) can drive the traction wheels to feed the strap; (2) can be reversed to drive traction wheels to withdraw the strap to pretension the strap loop about a package; (3) can drive the high tension pinion after a predetermined pretension level has been reached; and (4) can be reversed again to return the high tension pinion to its original, at rest position after applying high tension.

Operation and Control of the Strapping Cycle

With the various elements of the present invention as described above in mind, a brief description of the operation of a strapping machine will next be presented.

The initial conditions for the strapping machine are as follows: The machine is at rest and the strap is already in the strap chute to form a loop about a package, the loop having been formed as the last step of the prior strapping cycle.

Next, the machine is actuated through a conventional control mechanism to energize the strap gripping mechanism (within the gripping and sealing unit 50) to cause the strap free end to be gripped by a suitable gripping means such as gripping jaws.

Next, after the gripping jaws have gripped the strap free end in an appropriate manner, the single reversible motor is energized to rotate in the direction that rotates the traction wheels so as to withdraw the trailing strap and tighten the loop about the package with a predetermined level of pretension.

When the predetermined level of pretensioning has been applied to the strap, the biasing spring 458 on the cam latch assembly (FIG. 7) is overcome and the shaft 394 is permitted to rotate which, through the reduction gear train 342, rotates the high tension pinion 250. The high tension pinion 250 moves downwardly along rack 260 and pivots the high tension strap guide arm 70 downwardly away from the first, upper position.

When the pinion 250 starts to rotate, the rotation of the traction wheels has terminated. Though not required in the preferred embodiment, the latch wheel 490 can be provided to positively lock the traction wheels against rotation. If the latch wheel 490 is provided, spring 480 (FIG. 7) causes latch 474 to rotate in a counterclockwise direction into engagement with the latch wheel 490 to lock the shaft 150 against rotation and hence, to positively prevent rotation of the traction wheels. Of course, the latch 474 also acts through rod 470 to hold lever 436 out of engagement with cam 430 for the remainder of the high tension sequence.

It should also be noted that just as the high tension strap guide arm 70 begins to move downwardly, spring 198 biases gripper 194 about pin 196 so that the gripper teeth 199 are forced into contact with strap 36. This prevents the strap from slipping through strap guide arm 70 as high tension is pulled.

When the appropriate high tension level has been reached, the reaction force, being transmitted upwardly through rack 260 (see FIG. 4) urges lever 266 upwardly so that limit switch 294 is actuated to de-energize the motor 76 and actuate various other circuits, such as the strap loop sealing circuits and the strap severance circuits, whereby the gripping and sealing unit 50 is actuated to connect the overlapping loop strap ends by a sealless or seal connection and then to sever the trailing portion of strap from the loop. Next, the motor is energized in the opposite direction to reverse the rotation of pinion gear 250. Consequently, the pinion gear rotates back up the rack 260 until the high tensioning strap guide arm 70 assumes the position illustrated in FIGS. 2, 3, and 7. At this point, the cam 430 comes into contact with the roller 434.

With cam 430 rotating in the counterclockwise direction (as viewed in FIG. 7) when the arm 70 is in the first, upper position, the bearing notch 432 re-engages roller 434 to stop rotation of the cam. With further rotation of cam 430 prevented, the differential 340 then acts to transfer full motor torque to shaft 150. If a latch wheel 490 is used, the rod 470 has been urged downwardly by lever 436 to rotate latch 474 in a clockwise direction about shaft 478 to disengage latch 474 from the latch wheel 490. At this point, the shaft 150 is thus freed to rotate the traction wheels. In any case, since the direction of rotation of the motor was reversed by limit switch 294 when the high tension level was reached, the direction of the rotation of the shaft 150 is now in the direction necessary for feeding the strap forward into the strap chute to form another loop about a new package.

During the return of the high tension arm 70 to the first, upper position, the shaft 150, without the latch wheel 490, would not tend to feed the strap forward if the rotational resistance of the traction wheels in the direction of strap feed was greater than the torque required to rotate the pinion gear up the rack. This rotational resistance of the traction wheel is really the cumulative effect of the rotational friction in the strap supply reel 34, in the traction wheel gears 154 and 170, and in the shaft 150, as well as of the reaction force produced in trying to push the gripped strap forward against the still closed gripper 194. For the preferred embodiment, this rotational resistance of the traction wheels in this mode of operation is in fact greater than the torque required to rotate the pinion gear up the rack. A latch wheel 490 is thus not required in the preferred embodiment.

It should be noted that after the high tension level has been reached and the limit switch 294 actuated, and after the high tension strap guide arm 70 begins moving back up rack 260, the strap 36 in the high tension arm 70 is still gripped by the strap gripper 194. The strap remains gripped until the high tension arm 70 reaches the first, upper position (FIG. 2) whereby the spacer rod 200 disengages the gripper 194 from the strap. Thus, the strap, having been severed from the loop by the gripping and sealing unit 50, still projects upwardly and alongside the clockspring metal band 234. As the guide arm 70 moves upwardly, the severed end of the strap is pushed upwardly into the gripping and sealing unit 50 between strap guides 228 and 226 (FIG. 4). In this way, the clockspring metal band 234 prevents the strap 36 from buckling.

After the strap has been fed to form a proper loop (as may be determined by appropriate sensing levers and switches within the strap chute or by other means), the electric motor is de-energized and the machine is at rest.

Pinion Gear Torque Limiting Overload Protection

In the preferred embodiment, where the strap supply reel 34 and traction wheels 140 and 142 have sufficient rotation resistance, the latch wheel 490 need not be used. In this case, the traction wheels are not rotated by shaft 150 to continue pulling on the strap during high tensioning because the torque required to rotate the pinion through the gear train 342 is less than that required to rotate the traction wheels. The "absence" of the latch wheel 490 can be used to advantage to provide "overload protection" for the machine by limiting the amount of torque that can be applied to the pinion gear 250. Specifically, as illustrated in FIGS. 2, 3, and 4, a block 496 may be provided below the high tension strap guide arm 70 to prevent downward movement beyond a certain point. The block 496 can be supported by a suitable support post 498 attached to an appropriate point on the machine frame.

Should the high tension switch 294 or the electrical control circuit associated therewith fail to de-energize the motor 76 after the desired high tension level has been reached, further downward movement of the high tension arm 70 would bring the arm 70 into contact with the block 496. The torque required by the pinion gear 250 to overcome the "infinite resistance" of block 496 would immediately increase until it equaled the amount required to rotate the traction wheels 140 and 142. Then the traction wheels 140 and 142 would start to "slip" and rotate against the strap. The rotation and slipping of the wheels on the strap would occur because the motor power is transferred, through the differential 340, to the traction wheels when the pinion gear can no longer be rotated owing to the restraint of the high tension arm 70 by block 496 against further downward movement.

Further, still assuming a failure of the high tension level controls, if the strap were to break between the strap chute and the traction wheels as the high tension was being applied, the high tension arm 70 would eventually be driven downwardly and into contact with the block 406. Then the differential 340 would transfer the motor power to the traction wheels which would pull the broken strap length rearwardly. After the strap length passed out of the traction wheels, the traction wheels would continue to rotate against themselves. In any case, the rotation of the traction wheels under these "failure mode" conditions would prevent the transfer of excessive force to the rack 260 by the pinion gear 250.

Alternatively, instead of relying upon the traction wheels to slip or rotate against themselves to provide "overload protection" the pinion 250 can be designed to run off of the rack 260. To this end, the rack 260 is designed with a predetermined length and block 496 can be located with respect to the rack 260 such that, upon failure of the control circuit or tension level switch 294, the pinion gear 250 just barely runs off the bottom of the rack before the high tension arm 70 contacts the block 296. In this case, the block 496 is made of a somewhat resilient material. Then, after the pinion 250 has run off of the rack 260 and after the high tension arm 70 is in contact with, the supported by, block 496, the rotation of the pinion gear 250 in the high tension direction (clockwise as viewed in FIG. 4) will cause the teeth in the pinion 250 to impinge against, and rotate past, the lower side of the bottom tooth 499 on the rack 260. This will make a noise which will alert the operator to the situation. (Of course, machine shutdown cycle timers are also preferably incorporated in the machine so that this condition would not continue indefinitely if the operator fails to notice the disengagement of the pinion gear 250 from the rack 260.)

In order to re-engage the pinion gear 250 with the rack 260, it is only necessary to, through appropriate manually actuatable controls, reverse the rotation of the pinion gear 250 (that is, rotate the pinion gear 250 in the counterclockwise direction as viewed in FIG. 4) whereupon, owing in part to the resilience of the block 496, the teeth of the pinion gear 250 will automatically engage the teeth of the rack 260 so that the high tension arm 70 will begin moving upwardly.

When reversing the rotation of the pinion gear 250 and re-engaging the gear 250 with the rack 260, it is necessary to ensure that the machine is properly timed (i.e., that the cam 430 will engage the roller 434 at the point when the arm 70 is in the uppermost position). To this end a timing mark "T" is marked on a predetermined tooth of the pinion gear 250 as illustrated in FIG. 4. Then, with the pinion gear 250 still disengaged from rack 260 and with arm 70 supported by block 496, the pinion gear 250 is first rotated in the clockwise direction by suitable manually actuatable controls until the tooth marked "T" contacts the underside of the lowermost tooth 499 on the rack 260 as illustrated in FIG. 4. At this point, the rotation of the pinion gear 250 is stopped and then reversed (from clockwise to a counterclockwise direction as viewed in FIG. 4) to return the high tension arm 70 to its upper position.

Transfer of power through the differential 340 to the traction wheels can also be used to prevent damage to the machine if, for example, when the pinion gear 250 is rotating up the rack 260 a foreign object were to become jammed between the arm 70 and the bottom of the gripping and sealing assembly 50 (FIG. 4). The increased resistance to upward movement would be sensed by the differential 340 and, if this resistance was greater than the torque required to rotate the traction wheels, the traction wheels would preferentially start to rotate to feed strap against the engaged gripper 194. This would continue until, in the preferred embodiment a cycle timer (not illustrated) shut off the motor. Such a cycle timer would typically be provided in a strapping machine to shut off the motor if it runs beyond a certain period of time in any one sequence of the strapping cycle.

Though not required in the preferred embodiment, the latch wheel 490 can be incorporated in the machine to positively lock the traction wheels against rotation during high tensioning and during the return of the arm 70 to the upper position as previously described. In such an embodiment, the traction wheels cannot "slip" to provide an inherent overload protection. However, other protection means could be provided. For example, should there be a failure in the control circuit, an additional limit switch 494 may be provided on the strapping machine frame or guide member 226 near the bottom of the rack 260 and adjacent the front end of the high tensioning strap guide arm 70 as illustrated in FIGS. 2, 3, and 4. Then, with reference to FIG. 4, if the limit switch 294 or the electric control circuit associated therewith, fail to de-energize the motor 76 during the high tensioning sequence after the high tension level has been reached, the front end of the high tension arm 70 would contact limit switch 494, which limit switch 494 could be connected to de-energize the motor.

For additional protection, the above-described resilient block 496 can be located to prevent further downward movement of the high tension arm 70 at the point where the pinion 250 just disengages from rack 260. Then, if there were a failure of the switch 494 or of the associated control circuit, the pinion 250 would rotate off of the rack 260 and the arm 70 would then be supported by block 496. The arm 70 could be easily re-engaged with the rack by aligning the above-described pinion tooth marked "T" (FIGS. 2, 3, and 4), with the bottom tooth 499 on the rack 260 as illustrated in FIG. 4 and as previously discussed. At this point, energization of the motor to rotate the pinion 250 in the opposite direction would cause the pinion gear to rotate up the rack 260 so that the latching mechanisms (such as latch 474/latch wheel 490 and the cam 430/roller 434 illustrated in FIG. 7) would be in proper alignment for subsequent operation.

Regardless of whether or not a latch wheel 490 is used, it should be noted that if the coacting cam 430 and roller 434 fail to properly re-engage when the arm 70 is pivoted back up to the first, upper position, then the pinion 250 is prevented from forcing the arm 70 any further upwardly if the top tooth 500 on rack 260 is located substantially as shown in FIGS. 2 and 3 so that the pinion 250 would rotate off of the rack 260 if it went any higher.

Alternate Embodiments of the High Tension Drive Member and Reaction Means

It is contemplated that the novel high tension drive member (pinion 250) and the high tension reaction means (rack 260) may take other forms. For example, the high tension drive member or pinion could be replaced with a drum rotatable on an axis which is fixed relative to, and movable with, the pivotable strap guide arm 70. The high tension reaction means or rack could be replaced with a flexible member or cable wrapped around the drum with one end extending upwardly and secured to the strapping machine frame (or gripper and sealing unit 50) and with the other end extending downwardly and secured to the strapping machine frame or floor. Rotation of the drum, in the manner of the rotation of the pinion wheel 250, would cause the drum to move upwardly or downwardly, as the case may be, on the wound cable.

Alternatively, the high tension reaction means or rack could be replaced with a chain extending upwardly and mounted on the upper end to the strapping machine frame (or gripper and sealing unit 50) and mounted on the lower end to the strapping machine frame or floor. A suitable sprocket gear could be used in place of the pinion 250 to engage the chain and move the high tension strap guide arm 70 along the chain.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is of course intended to cover by the appended claims all such modifications as fall within the scope of the claims.

We claim:

1. A strap feeding and tensioning assembly for a strapping machine having a frame, strap chute and a strap end gripping and sealing unit, said feeding and tensioning assembly comprising:

a strap guide arm pivotably connected on one end to said strapping machine frame;

traction wheel means on said guide arm for feeding and withdrawing a length of strap into and out of said chute;

a gripper means on said guide arm for gripping said strap;

a high tension drive member rotatable on an axis which is fixed relative to, and movable with, said guide arm;

a reversible, rotatable drive motor;

a gear drive assembly means engaged with said motor for separately rotating (1) said traction wheel means to feed said strap and to withdraw said strap when one end is held by said strap end gripping and sealing unit and (2) said high tension drive member to apply a high tension to said strap; and a high tension reaction means connected to said strapping machine frame for engaging said high tension drive member and transferring the reaction force of said drive member to said strapping machine frame as said drive member is rotated in engagement with said reaction means, whereby said drive member moves along said reaction means causing said guide arm to (1) pivot, (2) actuate said gripper means to grip said strap, and (3) pull the gripped strap thereby drawing said high tension in said strap.

2. A strap feeding and tensioning assembly, mountable in a strapping machine frame adjacent a strap chute and a strap end gripping and sealing unit for (1) feeding a length of strap in a loop through the strap chute about an article, (2) drawing said loop about said article with an adjustable, predetermined, first tension when the leading end of said strap is gripped by said gripping and sealing assembly, and (3) applying an adjustable, higher, second tension to said strap loop after said loop has been drawn with said first tension, said strap feeding and tensioning assembly comprising:

a high tension strap guide arm means for guiding the strap, said guide arm means being pivotably connected on one end to said strapping machine frame and movable from a first arm position during the feeding of said strap and during drawing of said first tension to a second arm position while applying said second tension;

traction wheel means on said guide arm means for (1) feeding a length of strap into said chute to form a loop around said article with the leading end of the strap overlapping a segment of the strap and with a portion of the strap trailing the loop extending from the area of strap overlap and through said strap guide arm means to said traction means and (2) withdrawing a length of strap from said chute when the leading end of said strap is gripped by said gripping and sealing unit;

gripper means on said guide arm means for gripping a portion of the strap trailing said loop when said strap guide arm means pivots out of said first position;

a high tension drive member rotatable on an axis which is fixed relative to, and movable with, said pivotable strap guide arm means;

a reversible drive motor mounted for movement on said strap guide arm means and rotatable in a first direction and in a second direction;

a gear drive assembly means engaged with said motor and movable therewith for (1) rotating said traction wheel means to feed the strap when said motor is rotating in said first direction, (2) rotating said traction wheel means to withdraw said strap to tighten said loop with said first tension when said motor is rotating in said second direction, and (3) rotating said high tension drive member when said motor is rotating in the second direction and the tension in said strap exceeds said predetermined, first tension; and high tension reaction means connected to said strapping machine frame for engaging said rotatable high tension drive member and transferring the reaction force of said drive member to said strapping machine frame as said drive member is rotated in engagement therewith whereby said drive member moves along said high tension reaction means causing said strap guide arm means to (1) pivot from said first arm position to said second arm position, (2) actuate said gripper means to grip said trailing portion of said strap, and (3) pull the gripped strap, thereby drawing said higher, second tension in said loop.

3. The apparatus in accordance with claim 2 in which said high tension drive member includes a pinion gear and in which said high tension reaction means includes a rack for being engaged by said pinion gear, said rack being pivotably connected on one end to said strapping machine frame.

4. The apparatus in accordnce with claim 2 in which said gear drive assembly means includes a reduction gear train drivably connected to said high tension drive member and in which said apparatus further includes a rotatable cam connected to said gear train and an adjustable spring-biased first latch means for engaging said cam whereby, rotation of the cam and of the gear train is prevented when the input torque to the gear train is not greater than the input torque existing when said predetermined, first tension is drawn in said strap and whereby said spring-biased latch means is overcome to allow said cam and gear train to rotate when the input torque to the gear train is greater than the input torque existing when said first tension is drawn in said strap.

5. The apparatus in accordance with claim 4 in which said gear drive assembly includes a traction wheel means drive shaft, said traction wheel means connected therewith and being rotated thereby, said traction wheel means drive shaft having on one end, a latch wheel secured thereto and in which said apparatus further includes an adjustable spring-biased second latch means for engaging said latch wheel, said second latch means being mounted on said guide arm means and biased out of engagement with said latch wheel by reaction against said strapping machine frame when said guide arm means is in first arm position whereby rotation of said traction wheel means drive shaft is permitted when said guide arm is in said first arm position and whereby rotation of said traction means drive shaft is prevented when said guide arm means is pivoted away from said first arm position so that said second latch means engages said latch wheel.

6. The apparatus in accordance with claim 2 in which (1) said apparatus further includes a mounting lever which is pivoted on one end to said strapping machine frame and means for biasing said lever from a first to a second lever position; (2) said high tension reaction means in pivotably connected to said mounting lever; and (3) said apparatus further includes a limit switch adapted to be contacted by said lever in said first lever position whereby, when the force transmitted by said high tension drive member to said high tension reaction means overcomes said mounting lever biasing means and moves said mounting lever from said second to said first lever position against said limit switch, said motor is actuated to reverse direction and rotate said high tension drive member along said high tension reaction means thereby pivoting said guide arm means from said second arm position to said first arm position.

7. The apparatus in accordance with claim 2 in which said gripper means on said guide arm means includes a pivotable gripper member adjacent said strap and biasing means for rotating said gripper member in one direction about an axis against the strap in said guide arm means and further includes a spacer member slidably disposed between a portion of said strapping machine frame and said gripper member to hold said gripper member against said biasing means out of contact with said strap when said guide arm means is in said first arm position whereby, when said guide arm means moves away from said first arm position, said biasing means rotates said gripper member against said strap.

8. The apparatus in accordance with claim 2 further including a shock absorbing member on said strapping machine frame adjacent said guide arm means in said second arm position, whereby if said high tension drive member becomes accidentally disengaged from said high tension reaction means, said absorbing member absorbs the impact of said strap guide arm means and prevents further movement thereof.

9. The apparatus in accordance with claim 2 in which said gear drive assembly means includes (1) a differential gear drive; (2) a traction wheel means drive shaft connecting said differential gear drive to said traction wheel means; and (3) at least one shaft driven from said differential gear drive to rotate said high tension drive member.

10. The apparatus in accordance with claim 9 wherein said traction wheel means includes a pair of oppositely rotatable, generally smooth surfaced traction wheels adapted to engage between them said strap whereby said wheels slippingly rotate against the strap when the torque applied to said high tension drive member exceeds a predetermined amount.

11. The apparatus in accordance with claim 9 in which said gear drive assembly means further includes reduction gear train means for rotating said high tension drive member at a reduced speed for applying high tension.

12. The apparatus in accordance with claim 2 further including a strap guide wheel mounted for rotation on an axis which is fixed relative to, and movable with, said pivotable guide arm means and further including a metal band spring mounted at one end to the periphery of said guide wheel and mounted at the other end to said strapping machine frame whereby said band winds around a portion of the periphery of said guide wheel when said arm means is in said first position and unwinds to form a guide surface for said strap when said arm means moves away from said first position.

13. A strap feeding and tensioning assembly, mountable in a strapping machine frame adjacent a strap chute and a strap end gripping and sealing assembly, comprising:

a strap guide arm pivotably connected on one end to said strapping machine frame;

at least one traction wheel on said guide arm for feeding and withdrawing a length of strap;

a pivotable gripper on said guide arm for gripping a portion of the strap in the guide arm;

a high tension pinion gear rotatable on an axis which is fixed relative to, and movable with, said pivotable strap guide arm;

a single, reversible, rotatable drive motor;

a gear drive assembly means engaged with said motor for (1) rotating said traction wheel to feed the strap into said chute to form a loop when said motor is rotating in a first direction, (2) rotating said traction wheel to withdraw said strap to tighten said loop with said first tension when said motor is rotating in a second direction, and (3) rotating said high tension drive member when said motor is rotating in the second direction and the tension in said strap exceeds said predetermined, first tension; and a rack connected to said strapping machine frame for engaging said pinion gear and transferring the reaction force of said pinion gear to said strapping machine frame as said pinion gear is rotated in engagement therewith, whereby said pinion gear moves along said rack causing said strap guide arm to (1) pivot, (2) actuate said gripper to grip said strap, and (3) pull the gripped strap thereby drawing said higher, second tension in said loop.

* * * * *